US006415962B1

(12) United States Patent
Bougamont et al.

(10) Patent No.: US 6,415,962 B1
(45) Date of Patent: Jul. 9, 2002

(54) DEVICE FOR CONNECTING A PUMP

(75) Inventors: Jean-Louis Bougamont, Eu; Bernard Clerget, Haudivilliers; Christophe Roy, Dieppe, all of (FR)

(73) Assignee: Rexam Sofab, Le Treport (FR)

( * ) Notice: Subject to any disclaimer, the term of this patent is extended or adjusted under 35 U.S.C. 154(b) by 0 days.

(21) Appl. No.: 09/856,726

(22) PCT Filed: Nov. 26, 1999

(86) PCT No.: PCT/FR99/02934

§ 371 (c)(1),
(2), (4) Date: May 25, 2001

(87) PCT Pub. No.: WO00/32316

PCT Pub. Date: Jun. 8, 2000

(30) Foreign Application Priority Data

Nov. 27, 1998 (FR) ..... 98 14948

(51) Int. Cl.[7] ..... B65D 88/54
(52) U.S. Cl. ..... 222/321.7
(58) Field of Search ..... 222/94, 95, 105, 222/385, 389, 402.16, 402.18, 321.9, 321.7

(56) References Cited

U.S. PATENT DOCUMENTS 4,189,069 A * 2/1980 Stoody ..... 222/94
4,211,344 A * 7/1980 Stoody ..... 222/94
4,375,743 A * 3/1983 Sullivan ..... 222/389
5,031,384 A * 7/1991 Rebeyrolle ..... 222/95
5,139,168 A 8/1992 Gueret
5,492,252 A 2/1996 Gueret
5,730,326 A * 3/1998 Kaeser ..... 222/95
6,021,924 A * 2/2000 Suck et al. ..... 222/105
6,070,763 A * 6/2000 Gueret ..... 222/95
6,085,945 A * 7/2000 Fransen ..... 222/402.18

FOREIGN PATENT DOCUMENTS

EP 0622311 11/1994
FR 2382946 10/1978

* cited by examiner

*Primary Examiner*—William C. Doerrler
*Assistant Examiner*—Thach H Bui
(74) *Attorney, Agent, or Firm*—Bacon & Thomas, PLLC

(57) ABSTRACT

A device for connecting the body (C) of a pump (P) to a flexible bag (S) containing a liquid or semi-liquid fluid, the device being characterized in that it comprises a cylindrical sleeve (10) for leakproof fixing of the bag (S), which sleeve is connected at the top to a shoulder (11) carrying firstly a peripheral ring (13) for assembly with the wall of a rigid outer container (B) and secondly a central bushing (12) for leakproof support of the pump (P).

10 Claims, 1 Drawing Sheet

DEVICE FOR CONNECTING A PUMP

BACKGROUND OF THE PRESENT INVENTION

The present invention relates to a device for connecting a pump to a flexible bag containing a liquid or semi-liquid fluid for the purpose of making up a dispenser that does not take in air.

So-called "airless" dispensers, i.e. those that operate without taking air into the reservoir, comprise a pump constituted in particular by a pump body provided at its bottom end with an admission orifice suitable for communicating with the inside volume of a flexible bag forming the reservoir of fluid to be dispensed. The bag is fixed in leakproof manner to the body of the pump and it is generally enclosed in external packaging or covering that is more rigid.

Nevertheless, such dispensers cannot be refilled, specifically because the pump and the bag and sometimes also the outer covering are assembled together in definitive manner so that any separation thereof gives rise to an irreversible loss of sealing.

In addition, the pump-and-bag assembly does not constitute a single unit that can be fitted to any outer covering. For reasons of marketing, the shape and dimensions of such covering are defined by the manufacturers of fluids to be dispensed and therefore differ from one fluid to another, thereby giving rise to connection problems.

SUMMARY OF THE INVENTION

U.S. Pat. No. 5,139,168 discloses a device for connecting the body of a pump to a flexible bag containing a liquid or semi-liquid fluid, the device comprising a cylindrical sleeve for leakproof fixing of the bag, the top of the sleeve being connected to a shoulder that carries firstly a peripheral ring for assembly with the wall of a rigid outer container, and secondly a central bushing for leakproof support of the pump.

However, that device does not provide satisfactory sealing for all types of pump.

An object of the present invention is to resolve the above-mentioned technical problems in satisfactory manner.

According to the invention, this object is achieved by means of a device for connecting the body of a pump to a flexible bag containing a liquid or semi-liquid fluid, the device being characterized in that said bushing is provided with an internal ferrule in which the body of the pump is releasably engaged and held by radial clamping.

Preferably, said ferrule is placed inside the bag-fixing sleeve.

According to another characteristic, the device further comprises a locking and covering collar for holding said pump captive by being fitted over the central bushing.

In a variant, said collar has means for retaining it on the central bushing.

In another variant, said collar is constituted by a bottom portion having an outer skirt provided with snap-fastening members for engaging the central bushing, and is extended by a top portion of small diameter provided with a transverse wall bearing axially against the body of the pump.

In yet another variant, said collar has an annular engagement channel for receiving the top end of the bushing.

According to yet another characteristic, said peripheral ring is provided with an orifice to allow outside air to penetrate.

According to other characteristics, said peripheral ring is releasably assembled to the outer container by means of snap-fastening members.

Preferably, said fixing sleeve is adapted to be heat-sealed to the bag.

Where appropriate, the device of the invention makes it easy to separate the pump from the bag in order to refill the bag.

In addition, the peripheral ring makes it possible for the pump-and-bag assembly to be docked in optionally removable manner to the outer packaging whose profile and shape can be arbitrary, thus conferring great flexibility in use and making it possible to use refills.

Furthermore, since the pump is not connected in definitive manner to the bag, it is possible in simple and rapid manner to exchange a pump if it does not operate properly or if the method of dispensing is to be changed (e.g. to go from an "airless" mode to an atmospheric mode).

The device of the invention makes it possible to provide a dispenser system in the form of a pump-and-bag assembly which is completely independent and ready for use if the bag has already been filled with fluid. The system can be packaged quickly and easily in a variety of outer housings of shapes that are characteristic of trademarks for goods.

Thus, it is possible to sell a refill constituted by the above dispenser system and suitable for fixing to a personalized container that can be sold separately, for example.

The device of the invention also makes it possible to fill the bag from the bottom before it is inserted into the container, thus making high rates of throughput possible; the bottom of the bag can then be closed after it has been filled, e.g. by heat-sealing directly through the stream of fluid.

Furthermore, the device of the invention is equally applicable to a pump that has a vent and to a pump that does not have a vent.

BRIEF DESCRIPTION OF THE DRAWINGS

The invention will be better understood on reading the following description accompanied by the drawing, in which.

DETAILED DESCRIPTION OF THE PRESENT INVENTION

Figure 1:
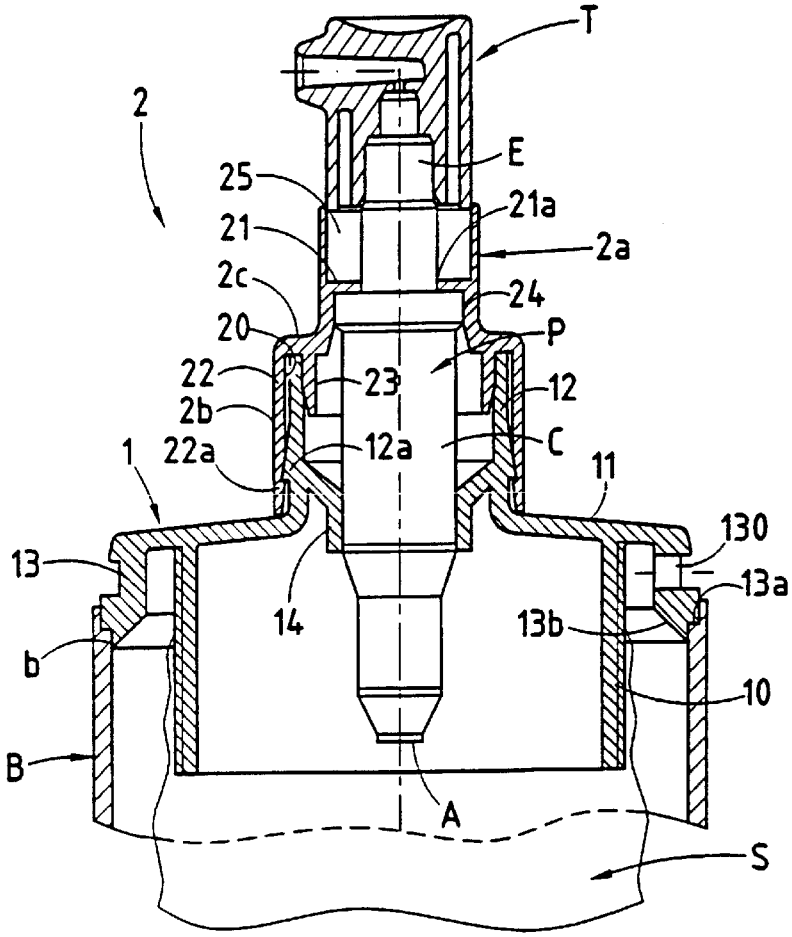
FIG. 1 is a section view of a first embodiment of the device of the invention.

The device shown in the figures is for connecting a pump P and more particularly an "airless" pump to a flexible bag S that forms a reservoir of liquid or semi-liquid fluid.

The pump P in this case does not have a vent and it is fitted with an axially-movable dispenser head T covering an exhaust duct E that projects upwards out from the body C of the pump P.

The connection device comprises a bottom connection element 1 constituted by a cylindrical sleeve 10 for fixing in leakproof manner to the bag S, the top of the sleeve being connected to a shoulder 11 carrying firstly a peripheral ring 13 for assembly with the wall of outer packaging, and secondly a central bushing 12 for supporting the pump P in leakproof manner. The outer packaging is preferably formed by a rigid container B of arbitrary shape, but it must nevertheless present a top edge suitable for being connected mechanically in simple manner with the ring 13 of the bottom element 1. Where appropriate, this connection can be provided in releasable manner by means of suitable snap-fastening or screw-fastening members.

To this end, the bottom edge of the ring 13 has on the outside a right-angled section 13*a* suitable for fixing (e.g. by adhesive or heat-sealing) so as to be wedged against a setback b formed in the top edge of the inside wall of the container B.

The diameter of the opening of the container B is larger than the diameter of the sleeve 10 and the bag is stiffened near its top end by said sleeve, so the pump-and-bag assembly can be inserted in and secured to the container B quickly and easily.

The inside of the section of the bottom edge of the ring 13 is preferably chamfered at 13*b*. If the container is hermetically closed, and if the ring 13 is fixed thereto in leakproof manner, then a vent-forming orifice 130 is provided through the side wall of the ring 13 so as to allow outside air to penetrate and compensate inside the container B for the suction generated by the bag shrinking progressively as fluid is dispensed therefrom.

The central bushing 12 has an internal ferrule 14 preferably lying coaxially with the sleeve 10 and suitable for receiving the cylindrical body C of the pump B in releasable manner.

Radial clamping is applied only to the top portion of the body C of the pump P which is of larger diameter. In the embodiment of FIG. 1, the fixing sleeve 10 for the bag S surrounds the ferrule 14 coaxially and thus also surrounds the bottom portion of the body C which is thus left free, thereby enabling the admission orifice A situated at the tapering bottom end of the body C to come directly into contact with the fluid.

In a variant that is not shown it is also possible for the internal ferrule 14 to lie off the axis of the sleeve 10.

Figure 2:
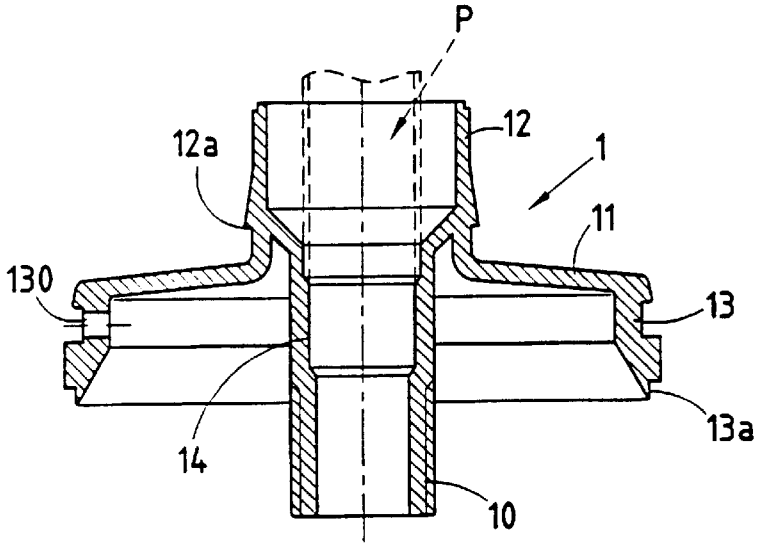
FIG. 2 is a section view of a second embodiment of the device of the invention.

In the embodiment of FIG. 2, the sleeve 10 coaxially extends the ferrule 14 but radial clamping of the pump body is still provided only via the sleeve.

In all embodiments, the sleeve 10 projects downwards from the plane defined by the bottom edge of the ring 13.

In the embodiment shown in FIGS. 1 and 2, the device also has a top element constituted by a collar 2 for locking the pump P and covering the bushing 12 of the bottom element 1.

The top portion 2*a* of the collar 2 is connected to the bottom portion 2*b* of small diameter via a shoulder 2*c*. The top portion 2*a* has a transverse wall 21 which bears axially on the top portion of the body C of the pump P so as hold it captive between the collar 2 and the bushing 12. The transverse wall 21 is provided with a central bore 21*a* for receiving the exhaust duct E from the pump P.

The top portion 2*a* also has an internal zone 24 for snap-fastening the top portion of the pump body, and an external zone 25 for axially guiding the dispenser head T.

The bottom portion 2*b* of the collar 2 is formed by an external skirt 22 provided with retaining means on the central bushing 12. These means comprise snap-fastening members 22*a* made on the inside face of the skirt 22 and designed to co-operate with complementary members 12*a* carried by the outer face of the bushing 12.

The bottom portion 2*b* preferably has an upside-down annular channel 20 defined between the inside face of the skirt 22 and an internal cylindrical flank 23 carried by the shoulder 2*c*.

The channel 20 receives the top edge of the bushing 12 when the snap-fastening members 22*a* of the skirt 22 are locked to the members 12*a* so as to ensure that the top element 2 is secured to the bottom element 1.

In this position, the bottom edge of the skirt 22 comes into abutment against the shoulder 11.

When the device of the invention is applied to a vent-less pump (as shown in FIG. 1), sealing is provided mainly by co-operation between the wall 21 with the snap-fastening zone 24 and the top portion of the body C of the pump P with its exhaust duct E.

When the device of the invention is applied to a pump body provided with a vent hole (not shown) provided between the ferrule 14 and the snap-fastening zone 24, the necessary sealing is then provided by radial clamping of the ferrule 14 on the body C.

What is claimed is:

1. A device for connecting a body (C) of a pump (P) to a flexible bag (S) containing a liquid or semi-liquid fluid and enclosed by a rigid outer container, the device comprising:

a cylindrical sleeve (10) for leakproof fixing of the bag (S);

a shoulder (11) connecting to a top portion of said sleeve, said shoulder (11) carrying a peripheral ring (13) arranged to cooperate with a wall of said rigid outer container (B) and a central bushing (12) configured to provide leakproof support of the pump (P); and an internal ferrule (14) extending from said central bushing and arranged such that the body (C) of the pump (P) is releasably engaged and supported therewith by radial clamping.

2. The device according to claim 1, wherein said ferrule (14) is positioned inside the bag-fixing sleeve (10).

3. The device according to claim 1 or 2, further comprising a locking and covering collar (2) for securing said pump (P) by being fitted over the central bushing (12).

4. The device according to claim 3, wherein said collar (2) includes a retaining device in cooperation with the central bushing (12).

5. The device according to claim 3, wherein said collar (2) defines a bottom portion (2*b*) having an outer skirt (22) provided with snap-fastening members (22*a*) for engaging the central bushing (12), and a top portion (2*a*) having a small diameter provided with a transverse wall (21) bearing axially against the body (C) of the pump.

6. The device according to claim 5, wherein said collar (2) has an annular engagement channel (20) for receiving the top end of the bushing (12).

7. The device according to claim 3, wherein said peripheral ring (13) includes an orifice (130) permitting outside air to penetrate therein.

8. The device according to claim 3, wherein said peripheral ring (13) is releasably assembled to the outer container (B) by means of snap-fastening members.

9. The device according to claim 3, wherein said fixing sleeve (10) is configured to be heat-sealed to the bag (S).

10. The use of a device according to claim 1 to provide a pump-and-bag assembly ready for use.

* * * * *